US005396819A

United States Patent [19]

Bradley

[11] Patent Number: 5,396,819

[45] Date of Patent: Mar. 14, 1995

[54] SOCKET WRENCH

[76] Inventor: Robert E. Bradley, 02806-036, P.O. Box 8000, Bradford, Pa. 16701

[21] Appl. No.: 59,210

[22] Filed: May 7, 1993

[51] Int. Cl.[6] ..... B25B 13/06; B25B 23/10

[52] U.S. Cl. ..... 81/124.1; 81/125; 81/177.4; 81/185

[58] Field of Search ..... 81/124.1, 125, 124.4, 81/177.4, DIG. 11, 185

[56] References Cited

U.S. PATENT DOCUMENTS

| | | | |
|---|---|---|---|
| 1,490,739 | 4/1924 | Hewitt, Jr. | 81/124.1 |
| 1,543,175 | 6/1925 | McCarthy . | |
| 1,629,217 | 5/1927 | Largent et al. | 81/124.1 |
| 2,412,275 | 12/1946 | Klopovic | 81/125 |
| 2,420,741 | 5/1947 | Ericksson | 81/125 |
| 2,616,322 | 11/1952 | Spreng | 81/52.4 |
| 2,834,241 | 5/1958 | Chowning | 81/125 |
| 2,895,365 | 7/1959 | Myers et al. | 81/186 |
| 2,930,267 | 3/1960 | Apicelli | 81/52.4 |
| 2,993,397 | 7/1961 | Albertson et al. | 81/125 |
| 3,005,367 | 10/1961 | Vose | 81/125 |
| 3,416,395 | 12/1968 | Hanson | 81/125 |
| 4,236,266 | 12/1980 | Hannah et al. | 81/124.4 X |
| 4,244,246 | 1/1981 | Gillett | 81/125 |
| 4,474,090 | 10/1984 | Berecz | 81/431 |
| 4,663,998 | 5/1987 | Parsons et al. | 81/125 |
| 4,836,067 | 6/1989 | Rogers et al. | 81/185 |
| 4,919,020 | 4/1990 | Huebschen | 81/125 |
| 5,101,695 | 4/1992 | Johnson | 81/124.6 |

FOREIGN PATENT DOCUMENTS

| | | | |
|---|---|---|---|
| 402949 | 11/1945 | Italy | 81/124.1 |
| 498862 | 1/1939 | United Kingdom | 81/124.1 |

*Primary Examiner*—D. S. Meislin
*Attorney, Agent, or Firm*—Hale and Dorr

[57] ABSTRACT

A socket wrench has a rotatable cylindrical body with an elongated interior channel for storing a plurality of nuts. The channel has a nut opening at a first end for receiving and removing nuts from the channel. A longitudinally slidable and axially rotatable roller grip assembly is provided on the exterior of the body. The roller grip assembly is attached to an interior backplate that moves longitudinally within the body channel. The roller grip assembly allows an operator both to urge the stored nuts toward the nut opening of the wrench, eject the nuts from the chamber, and to hold the wrench while the body is rotating.

19 Claims, 7 Drawing Sheets

SOCKET WRENCH

BACKGROUND

The present invention relates to multiple nut capacity socket wrenches.

Standard impact socket wrenches are currently used to attach and remove nuts on automobile wheels by placing the socket over the nut, unscrewing the nut, and then removing the nut from the tool. Using currently available socket tools, nuts are attached by initially screwing on the nut by hand and then using the socket tool to completely screw on the nut. This process currently used to change nuts on automobile tires and other devices requires much handling and is thus time consuming, and there is a risk that a nut, after being unscrewed, will be lost.

In addition, the entire standard impact socket wrench usually must be replaced after 8 to 12 months of continuous use. Because a wheel lug nut is recessed into the rim of the tire, only the "hex" part of the nut protrudes for the wrench to access. Therefore, when the nuts are unscrewed using an impact gun, all of the "breaking" impact force of the wrench is applied to the tip of the nut barrel, causing the very tip of the nut barrel to receive extreme wear during use.

It therefore an object of the present invention to provide a multiple nut socket tool that automatically stores each nut as it is unscrewed and then either allows all of the nuts that are stored in the tool to be ejected from the tool or allows the nuts to be attached to studs on the wheel by positioning the tool against the stud and spinning on the nut.

It is an additional object to provide a socket tool that has a roller grip assembly that moves longitudinally along the body of the tool and rotates relative to the tool body, allowing an operator to grip the tool and to control the movement of nuts into and out of the tool.

It is a further object to provide a multiple nut socket tool that has a replaceable insert tip, allowing the area of extreme wear to be replaced without replacing the entire tip.

SUMMARY

The socket wrench of the present invention comprises a rotatable circularly cylindrical body with an elongated interior channel. The channel extends longitudinally through the body, from a nut opening at a first end of the body to the opposite end of the body, where a drive shaft adaptor is provided to allow attachment of the tool to a source of rotary power.

The interior channel is comprised of two adjacent portions, a nut chamber and a backplate channel. The nut chamber portion of the channel is used to store a plurality of nuts. A nut opening is provided at a first end for receiving a plurality of nuts. Detent members are provided in the tool near the nut opening to hold the nuts in the nut chamber. A backplate moves longitudinally within both the nut chamber and the backplate channel portions of the interior channel. The backplate is attached to a longitudinally slidable roller grip assembly located on the exterior of the tool body. At least a portion of the roller grip assembly is axially rotatable. The roller grip assembly and the backplate together comprise a nut ejector that allows an operator both to urge the stored nuts toward the nut opening of the wrench, eject the nuts from the chamber, and to hold the wrench while the body is rotating.

In the preferred embodiment, the socket wrench has a replaceable insert tip, allowing the area of most wear in the wrench to be easily and economically replaced. The insert tip fits into a receptacle in the nut opening end of the socket wrench. The interior of the insert tip is configured to receive and engage a nut, and the exterior of the insert tip is configured to engage the receptacle portion of the tool body opening. The insert tip may be one of three different lengths, allowing either only the impact area to be replaced, to contain both the detent members and the impact area, or to extend the tip to include the length of the nut chamber, thus allowing one common tool body to be used with different-sized replaceable insert tips.

In an alternate embodiment, the nut backplate is attached to a collar that is non-rotatable relative to the body. The operator uses the collar to control the movement of nuts into and out of the tool, and may eject all of the stored nuts simultaneously.

BRIEF DESCRIPTION OF THE DRAWINGS

These and other features, aspects, and advantages of the present invention will become better understood with regard to the following description, appended claims, and accompanying drawings where:

Similar reference characters indicate similar or identical elements and portions throughout the specification and throughout the drawings.

DESCRIPTION OF PREFERRED EMBODIMENTS

Figure 1A:
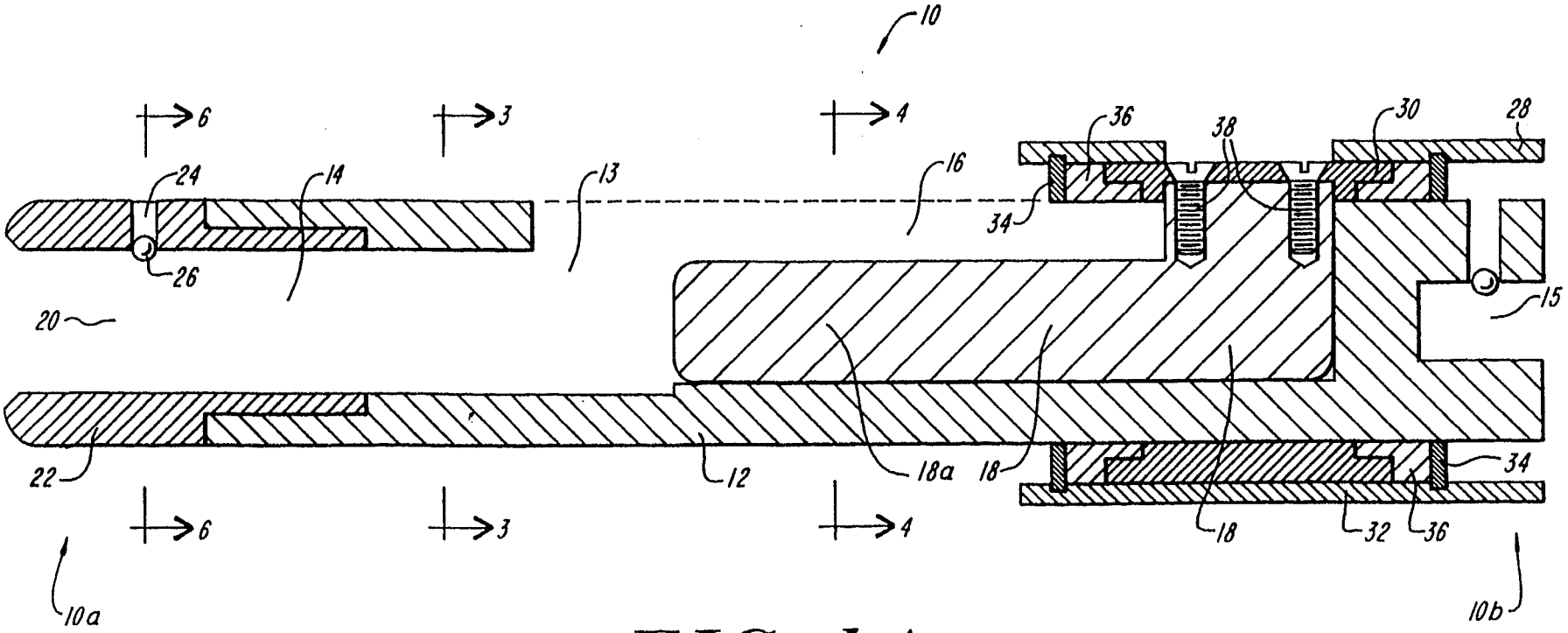
FIG. 1A is a longitudinal sectional view of the socket wrench with detent members in the insert tip and showing the socket wrench in a retracted position.
Figure 1B:
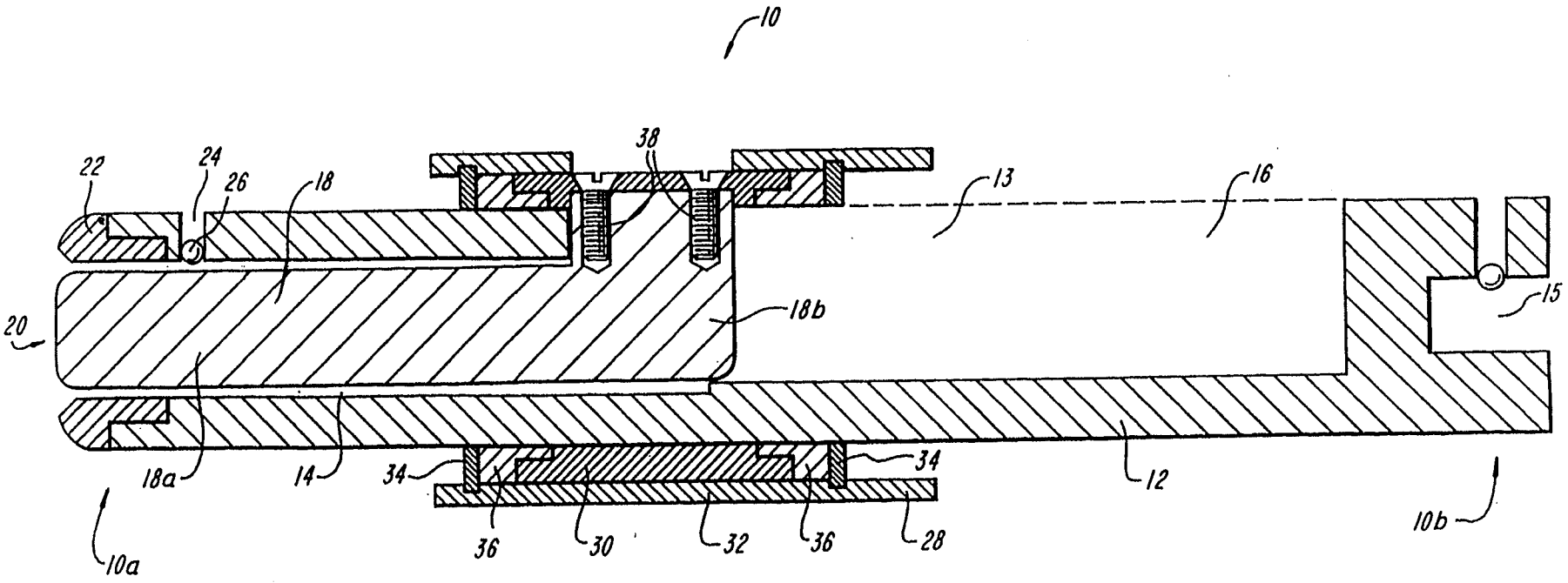
FIG. 1B is a longitudinal sectional view of the socket wrench with detent members in the tool body and showing the socket wrench in an extended position.
Figure 2:
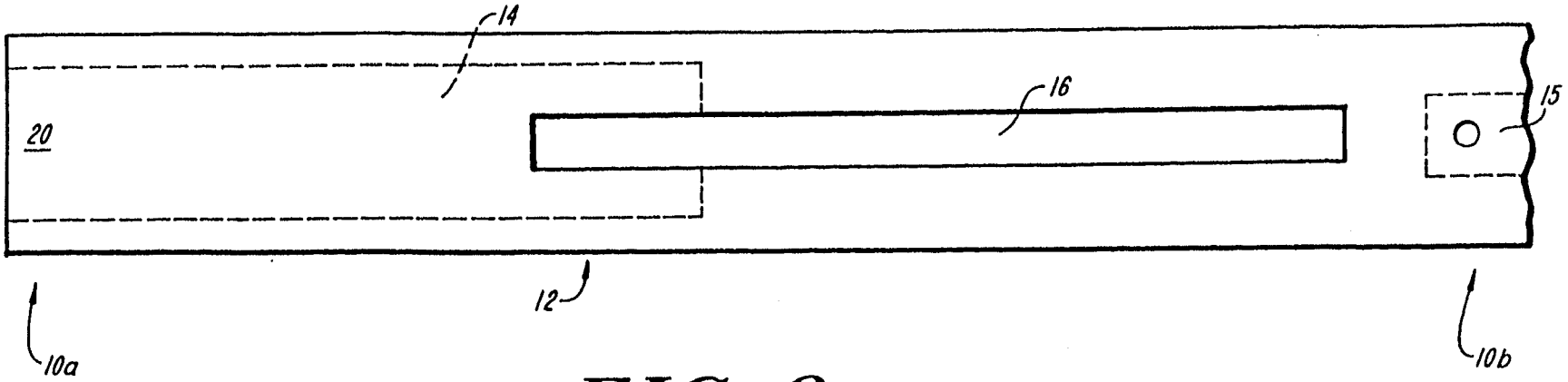
FIG. 2 shows the body of the socket wrench of FIG. 1A from a top view.

Referring to FIGS. 1A, 1B and 2, the socket wrench of the present invention is shown from various views. FIG. 1A shows a longitudinal section view of the socket wrench of the preferred embodiment in a retracted position. FIG. 1B shows an alternate embodiment of a the socket wrench in an extended position.

The socket tool includes an elongated circularly cylindrical steel body 12, which is shown from a top view in FIG. 2. In the preferred embodiment, the body is comprised of steel and extends to a total length of approximately 10 inches. The outside diameter of the tubular steel body 12 is preferably circular in cross-section and has a diameter of approximately $1\frac{1}{2}$ inches.

The body of the socket wrench has an interior chamber 13, which extends longitudinally through the body, from a nut opening 20 at a first end 10*a* of the body 12 to the opposite end 10*b* of the body 12, where a drive shaft adaptor 15 is provided to allow attachment of the tool to a source of rotary power (not shown). The interior chamber 13 is comprised of two adjacent sections, a nut chamber 14, and a backplate channel 16.

Figure 3:
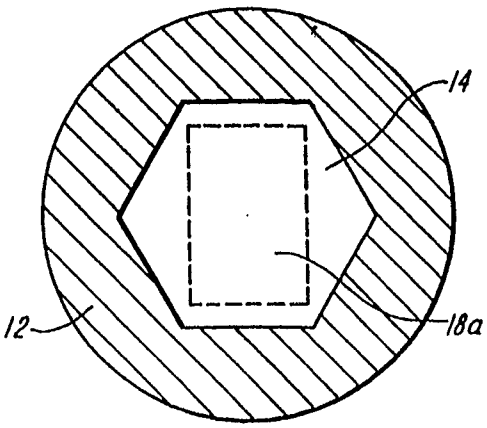
FIG. 3 shows the nut chamber of the socket wrench of FIG. 1A in a transverse sectional view taken along line 3—3 of FIG. 1A.

The nut chamber 14, shown in cross-section in FIG. 3, is contained within the steel body 12. It extends longitudinally from the nut-receiving end 10*a* towards the center of the socket wrench approximately $4\frac{1}{8}$ inches. The tool body 12 is hexagonal in interior cross-section for the length of the nut chamber. In the preferred embodiment, the nut chamber holds up to six substantially identical nuts, although in alternate embodiments, the nut chamber 14 may be longer or shorter, depending upon the number and size of the nuts it is to hold. Up to six nuts may be stored in versions of the socket wrench for $\frac{3}{4}$ inch, 13/16 inch, and 22 mm nuts; up to 8 nuts may be stored in the $\frac{7}{8}$ inch socket wrench.

Figure 4:
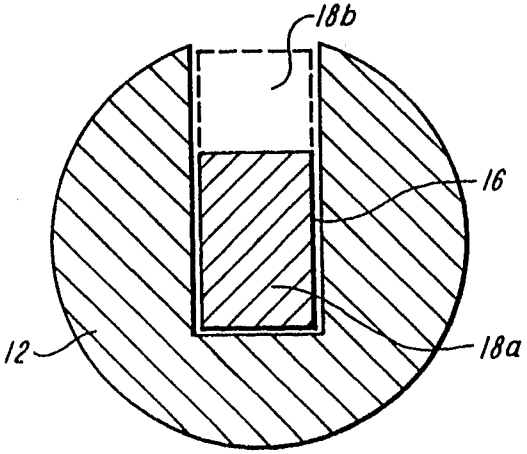
FIG. 4 shows the backplate channel and backplate of the socket wrench of FIG. 1A in a transverse sectional view taken along line 4—4 of FIG. 1A.

The backplate channel 16, shown in cross-section in FIG. 4, extends longitudinally through the wrench body 12 from the inner end of the nut chamber 14 to approximately $1\frac{3}{4}$ inches from the adaptor end 10*b* of the socket wrench. The backplate channel 16 is rectangular in cross-section. It is approximately $\frac{3}{8}$ inch wide and extends transversely from the top of the body into the body approximately $1\frac{1}{8}$ inches. The backplate channel 16 is machined into the tool body along the same axis as the nut chamber 14 and the tool body 12.

An L-shaped nut backplate 18 is contained within the tool body 12. The backplate 18 has a first rectangular portion 18*a* that extends longitudinally through the tool body, and a second rectangular portion 18*b* that extends transversely up through the backplate channel 16. The first rectangular portion 18*a* of the nut backplate 18 moves longitudinally within both the backplate channel 16 and the nut chamber 14. The second rectangular portion 18*b* moves longitudinally within the backplate channel 16 only.

When the backplate 18 is in a first, extended position as shown in FIG. 1B, the first rectangular portion 18*a* acts to force nuts out of the nut chamber and the second rectangular portion 18*b* reaches the end of the backplate channel 16, thus preventing the first backplate portion 18*a* from extending past the opening 20 of the nut chamber 12. When the backplate is in a second, retracted position as shown in FIG. 1A, the first rectangular portion 18*a* is pulled fully back into the backplate channel and nuts are allowed to enter the nut chamber.

In the preferred embodiment, a roller-grip assembly 28 is provided to allow the operator to control the movement of the nut backplate 18 while the tool body 12 is rotating, providing greater tool stability. The roller-grip assembly 28 is slidably and rotatably mounted on the body 12. A portion of the roller-grip assembly is attached to the nut backplate 18 and, as the operator moves the roller-grip assembly longitudinally along the tool body 12, the nut backplate 18 moves longitudinally in the backplate channel 16 and nut chamber 14. The operator may hold and move the roller-grip assembly 28 while the body 12 is rotating.

Figure 5:
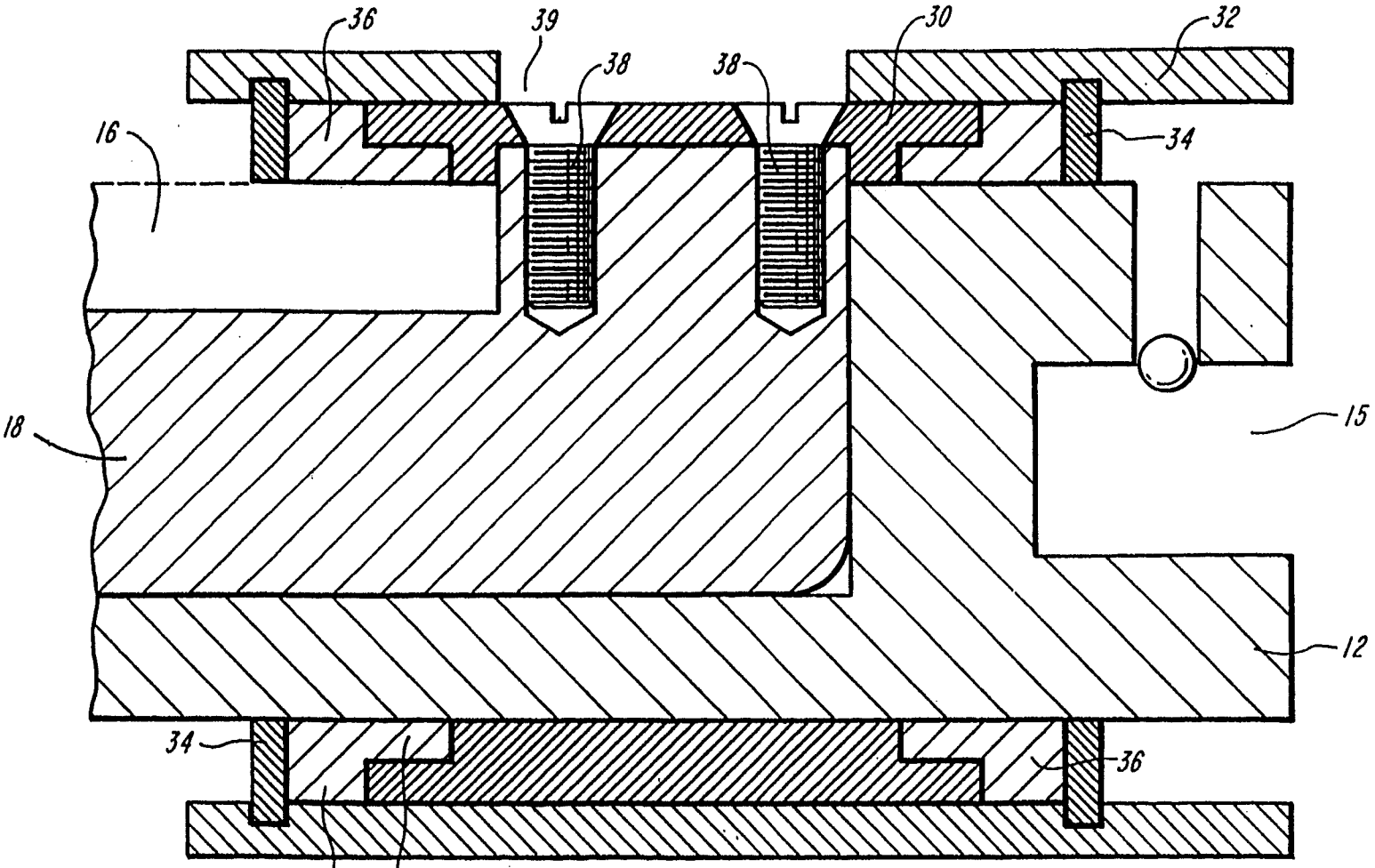
FIG. 5 is a cross-sectional view showing the roller grip assembly of the socket wrench of FIGS. 1A and 1B in greater detail.

FIG. 5 shows the roller-grip assembly in greater detail. The roller-grip assembly includes a cylindrical inside collar 30, a cylindrical outside collar 32, two flange bearings 36, two snap rings 34 and two screws 38. The inside and outside collars have annular cross-sections. The inside collar fits around the circumference of a portion of the tool body 12 and is attached by two screws 38 to nut backplate 18. The outside collar 32 is placed around the inside collar, and an access area 39 is provided in the outside collar to allow access to the screws 18. The outside collar pushes over the flange bearings 36 and is held in position over the inside collar by snap rings 34.

The flange bearings 36 are L-shaped in transverse cross-section, having a first vertically extending rectangular portion 36*a* and a second horizontally extending rectangular portion 36*b*. The ends of the inside collar are also L-shaped, and each flange bearing matingly contacts each end of the inside collar. The first vertically extending rectangular portion 36*a* fits between the outside collar 32 and the tool body 12, and the second horizontally extending rectangular portion 36*b* fits between the inside collar 30 and the tool body 12.

The flange bearings 36 are press-fitted into suitable counterbores at the ends of the outside collar 32 and are retained against longitudinal movement relative to the tool body 12 by snap rings 34. The flange bearings 36 are rotatable on the exterior surface of tubular body 12. They act to hold the inside collar 30 in alignment with the nut channel 14 and to hold the nut backplate 18 in alignment within the backplate channel 16.

The snap rings 34 are located adjacent to the flange bearings between the outside collar 32 and the tool body 12 at both ends of the outside collar. The two snap rings 34 maintain the axis of the outside collar 32 with the axis of the tool body 12.

Referring again to FIGS. 1A and 1B, an adaptor 15 is provided at the adaptor end 10*b* of the wrench 10 to receive the drive shaft of an independent power source (not shown). The adaptor 15 has a cross-sectional configuration adapted to receive a similarly-configured end of the drive shaft of the power source so that, during use, rotation of the drive shaft is imparted through the adaptor 15 to the body 12. The adaptor is designed to be applied and removed from the end of the drive shaft with any well-known fastening means.

Nuts are received and released through the opening 20 into the nut chamber 14 at the nut-receiving end 10*a* of the tool body 12. The opening 20 is constructed so as to receive a detachable replaceable insert tip 22. The insert tip 22 allows the area of the initial nut impact, the area having the greatest wear, to be replaced without replacing the entire tool.

In the preferred embodiment, the insert tip is comprised of hardened steel and is $2\frac{1}{4}$ inches in length, including both the initial nut impact area and a ball detent member area. In an alternate embodiment, the replaceable insert tip 22 is $\frac{3}{4}$ inches in length, and replaces only the initial nut impact area. In another alternate embodiment, the replaceable insert is equal to the full length of the nut chamber 14. The insert tip 22 is held to the tool body 12 either by press fit or by magnetism. In alternate embodiments, the insert tip may be threaded to the tool body.

Figure 6:
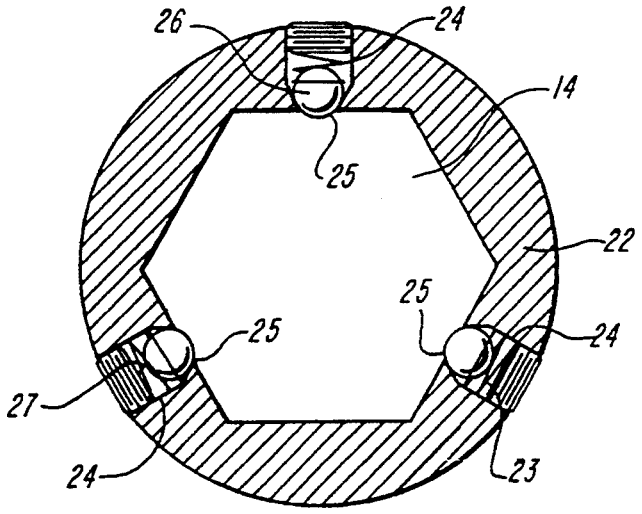
FIG. 6 shows the detent members of the socket wrench of FIG. 1A in a tranverse-sectional view taken along line 6—6 of FIG. 1A.

The detent members are shown in greater detail in FIG. 6. In the preferred embodiment, three axially-spaced detent members 24 are centrally located in a face of the hexagonal opening in the insert tip 22. The detent members 24 comprise metallic balls 26 radially spaced apart 120 degrees. Each ball 26 is received in a radially disposed opening 25 that is tapered and thereby reduced in diameter to prevent the ball from passing completely through the opening to the interior of the replaceable tip. A spring 23 in each opening forces the ball towards nut chamber 14 and each spring is held in place by screw 27.

The detent members protrude into the nut chamber 14 a sufficient distance to allow the nuts to force the balls 26 back against their retaining springs as the nut moves axially into the nut chamber. The spring pressure against the balls 26 provides a sufficient amount of force for the balls 26 to provide enough friction against the nut to retain them in the nut chamber.

In a normal state, the balls 26 project from the opening 24 into the nut chamber 14, thereby constituting an obstruction to axial movement of the nuts in the nut chamber. When the backplate 18 is urged forward towards opening 20, the backplate forces a nut against the balls and causes the balls to retract into the opening, thus allowing the nut to proceed past the ball detents.

In the preferred embodiment, the detent members 24 are located in the insert tip 22 away from the opening 20 a total distance equal to the height of one nut plus the diameter of a ball detent ($\frac{1}{8}$ inch in the preferred embodiment). This distance allows the detent members to be out of the impact area of the socket, thus reducing wear on the detents, while also retaining the other nuts in the nut chamber 14. In alternate embodiments, the detent members are located in the tool body, also a total distance equal to the height of one nut plus $\frac{1}{8}$ inch, from the nut opening.

Figure 7A:
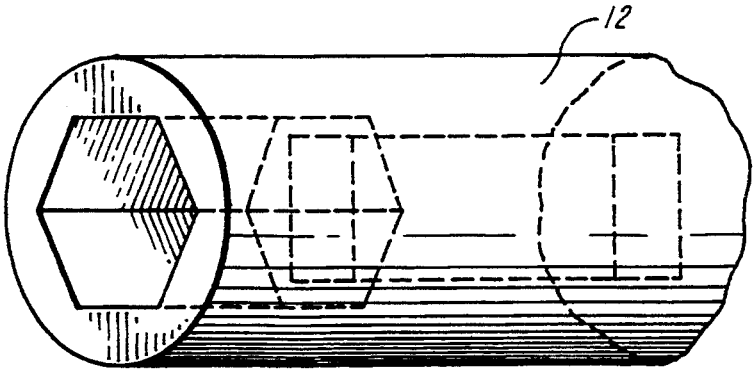
FIGS. 7A–7E show various embodiments of the replaceable insert tip and the receptacle for the replaceable insert tip of the socket wrench from various views.
Figure 7B:
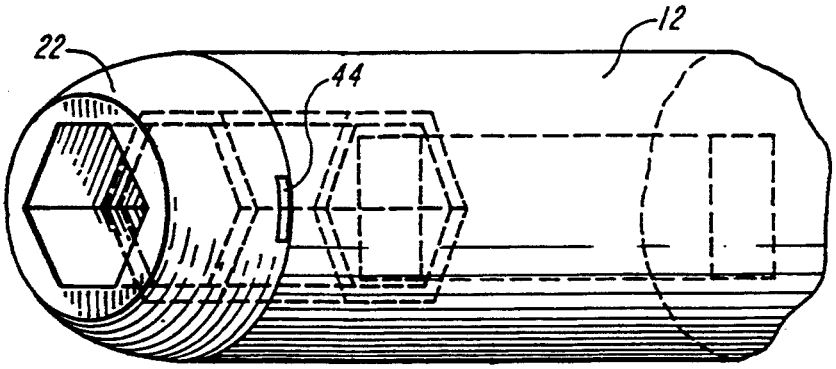
Figure 7C:
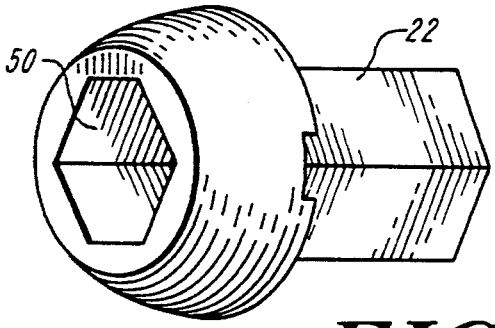
Figure 7D:
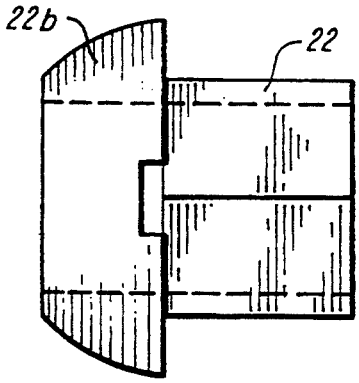

Referring to FIGS. 7A–7D, the replaceable $\frac{3}{4}$ inch insert tip and the receptacle for the $\frac{3}{4}$ inch insert tip are shown in greater detail. FIG. 7A shows the tool body 12 with a receptacle for the insert tip forged into the tool body. FIG. 7B shows the insert tip 22, which is magnetized, placed in the tool body. A removal slot 44 is provided into which a screwdriver is inserted to remove the insert tip. FIG. 7C shows the insert tip 22 from a front perspective view. A nut-shaped opening 50 of standard size and configuration is centrally disposed longitudinally through the socket insert 22. FIG. 7D is a side view of the insert tip showing an outwardly projecting cambered lip **22*b***, allowing the tool to better access the nut recessed in the wheel rim.

Figure 7E:
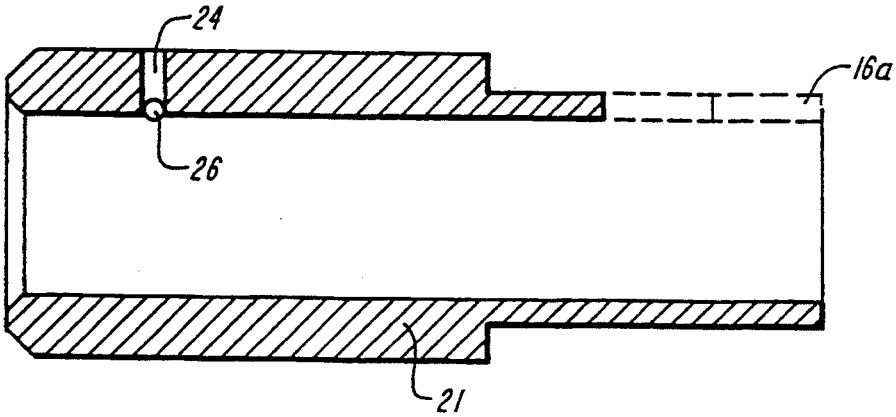

FIG. 7E shows a full length tip insert 21. Using this embodiment, one standard tool body may be used with different-sized nut socket inserts. The tip insert 21 has a backplate channel **16*a* which coincides with the backplate channel 16** when the tip insert is placed in the receptacle of the tool body.

The outer surface of the socket insert is designed to matingly engage the interior configuration of the insert receptacle in the tool body. In the preferred embodiment, both the exterior configuration of the socket insert and the interior configuration of the insert receptacle are hexagonal in cross-section, although in other embodiments, they may be some other shape. In other alternate embodiments, the exterior of the socket insert is threaded, allowing it to be screwed into corresponding threads in the interior of the receptacle.

Figure 8A:
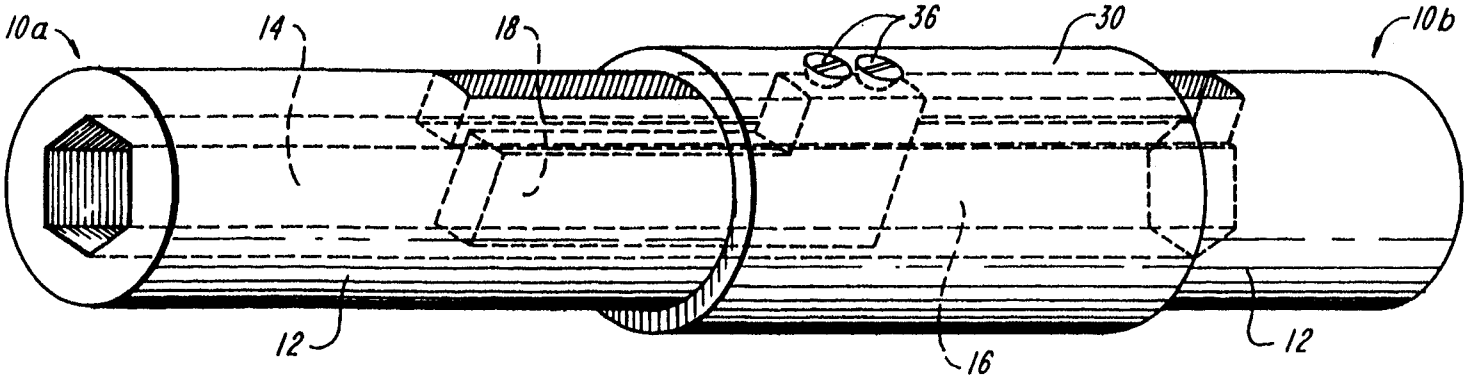
FIG. 8A is a perspective view of an alternate embodiment of a multiple nut socket wrench having a non-rotatable grip.

FIG. 8A shows an alternate embodiment in which the grip is not rotatable relative to the tool body 12. The tool is similar to that shown in FIGS. 1A and 1B, but does not have an outside collar, flange bearings or snap rings. The nut backplate 18 moves longitudinally within the backplate channel 16 and nut chamber 14 and is attached to the inside collar 30 using two screws 36, allowing the operator to force the backplate 18 against the nuts stored in the nut chamber, thus ejecting the nuts from the socket. This nut ejection device can be used on any socket, including a single socket, a deep-well socket, and an impact socket.

Figure 8B:
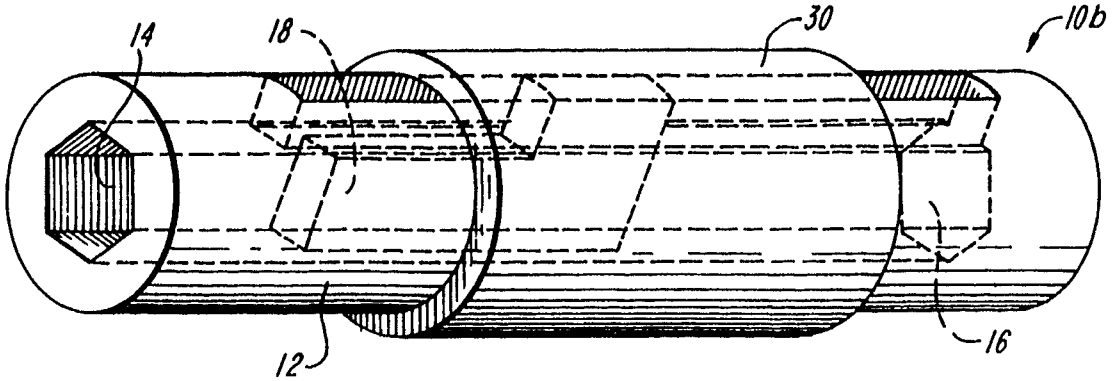
FIG. 8B is a perspective view of an alternate embodiment of a single nut socket wrench having a non-rotatable grip.

FIG. 8B shows an alternate embodiment in which the grip is not rotatable relative to the tool body 12 and the nut chamber holds only one nut. The nut backplate 18 moves longitudinally within the backplate channel 16 and the nut chamber 14. In this embodiment, the backplate 18 is comprised of thin, hardened steel. The backplate 18 is welded to the collar 30, allowing the operator to force the backplate 18 against the nut stored in the nut chamber, thus ejecting the nut from the socket.

Alternate embodiments of the socket wrench include a non-impact deep-well rotating socket wrench with a nut chamber and nut ejection and a single nut capacity impact socket equipped with a replaceable insert tip and drilled with 2 holes so as to allow the insertion of rods when its necessary to knock out a stuck nut from the nut chamber.

To use the socket wrench of the present invention, the operator places the opening 20 of the tool body 12 over a nut that is secured to a stud on a wheel or other device and retracts the roller-grip assembly 28 away from the opening, as shown in FIG. 1A. The socket wrench engages the external power source and rotates, thus backing the nut off the stud and up into the nut chamber 14. Because the nut on a wheel hub is recessed, only the hex area of the nut is in the nut chamber when the tool begins to operate. As the nut is loosened, it advances up into the nut chamber as it moves up the threaded stud. This movement of the nut into the nut chamber 14 forces the nut under the ball detents 26.

As the operator unscrews the second nut, which likewise moves into the nut chamber, the second nut pushes the first nut further into the nut chamber 14. After being unscrewed, the second nut takes the place of the first nut under the ball detents 26. When all of the nuts have been removed, the last nut in the chamber is under the ball detents 26, thus preventing any of the nuts from falling out of the nut chamber 14.

After one or more nuts have been unscrewed and are located in the nut chamber 14, the operator may either eject all of the nuts from the chamber or may reapply the individual nuts back upon the studs without hand contact with the nuts. To eject all of the nuts simultaneously, the operator slides the Roller-Grip assembly forward, as shown in FIG. 1B, thus moving the nut backplate 18 up against the nuts in the nut chamber 14 and forcing the nuts past the ball detents 26 and out of the nut chamber. The nut backplate 18 advances until it is flush with the opening 20 of the nut chamber 14.

To place the nuts back upon the studs, the operator places the opening 20 of the socket wrench over the stud and applies backpressure to the nut using the nut backplate 18 and the roller-grip assembly 30. The operator then engages the power source while holding the nut against the stud, causing the body 12 to rotate the nut onto the stud. When rotation begins, the operator releases the backpressure on the nut and allows a few rotations of the socket wrench body to start the threading of the nut onto the stud. Because the ball detents are located within the nut barrel away from the opening a total distance equal to the height of one nut plus the diameter of a ball detent, the second nut is detained far enough back into the nut chamber so that it is not threaded onto the stud with the first nut.

This procedure is repeated for each successive nut until all the of nuts except the last one in the nut chamber have been threaded onto their respective stud. After the last nut in the chamber is threaded all the way down on its stud, the operator can return to the other nuts and torque them down in a sequence as recommended by the manufacturer's specifications.

While the foregoing invention has been described with reference to particular embodiments, it should be understood that various modifications and alterations fall within the scope of the appended claims.

I claim:

1. A socket wrench comprising:

a cylindrical body, said body including an internal channel extending generally coaxially of said body from a first and open end thereof, a portion of said channel adjacent said open end being sized and adapted for receiving a plurality of nuts, and an axially extending slot extending radially through said body along at least a portion of the axial length of said body; and a nut ejector for ejecting a nut from said channel, said nut ejector including an axially extending nut engager section mounted within and longitudinally slidable within said channel of said body for urging a nut in said channel toward said open first end, and a hand grip section mounted outside of said body and having an outer portion and an inner portion, said outer portion being rotatable relative to said body and said nut engager section, and a radially-extending connector extending through said slot in said body and connecting said nut engager section to said inner portion of said hand grip section such that said inner portion of said hand grip section is fixed axially relative to said connector, and a pair of bearings spaced axially of said body on opposite sides of said connector, each of said bearings engaging the outer portion of said body and supporting the outer surface of said hand grip section for movement both axially and rotatably relative to said body and rotatably relative to said nut engager section.

2. The socket wrench of claim 1 further including means for releasably retaining said nut in said channel.

3. The socket wrench of claim 2 wherein said means for releasably retaining a nut in said channel comprise a plurality of spring-biased detent members, each of said detent members comprised of a ball and a spring contained within the wall of said body wherein each of said balls movably extend into said channel for inhibiting the free passage of a nut through said channel.

4. The socket wrench of claim 1, said channel further comprising a hexagonally shaped nut chamber portion wherein in a first extended position, said nut engager is moved into said nut chamber portion and is adjacent to said open end, and in a second retracted position, said nut engager is moved out of said nut chamber portion away from said open end.

5. The socket wrench of claim 1, wherein said outer portion comprises an outside tubular collar surrounding said inner portion and rotatably movable relative to said inside collar.

6. The socket wrench of claim 1 further comprising a connector at the end of said body opposite said open end, said connector arranged to engage said body with a rotary power source.

7. The socket wrench of claim 1 further comprising:

a cylindrical insert having a continuous open-ended wall structure defining an interior cross-section for receiving a nut; and said open end of said body having a recess for receiving said insert, said insert having an exterior area configured to matingly contact said recess of said body.

8. The socket wrench of claim 7, said insert further comprising a plurality of spring-biased detent members, each of said detent members comprised of a ball and a spring contained within the wall of said insert wherein each of said balls extend into said insert for inhibiting the free passage of a nut through said insert.

9. The socket wrench of claim 1, wherein said cylindrical body further includes a longitudinally extending slot sized and adapted for receiving said hand grip assembly for relative sliding movement toward and away from said first end.

10. The socket wrench of claim 1, wherein said slot terminates a distance from said first end greater than the thickness of a said nut.

11. The socket wrench of claim 1, wherein said nut engager section has a substantially rectangular cross-section.

12. A socket wrench comprising:

a cylindrical body, a nut ejector, and a hand grip assembly including an inner portion and an outer portion, said body including:

an internal channel extending generally coaxially of said body from a first and open end thereof, a portion of said channel adjacent said open end being sized and adapted for receiving a plurality of nuts, and an axially extending slot extending radially through said body along at least a portion of the axial length of said body, and said nut ejector including an axially extending nut engager section mounted within and longitudinally slidable within said channel of said body for urging a nut in said channel toward said open first end and a radially-extending connector extending through said slot in said body and connecting said nut engager section to said inner portion of said hand grip assembly such that relative to said connector said inner portion of said hand grip assembly is fixed axially, said outer portion of said hand grip assembly being rotatable relative to said body and said nut engager section and mounted outside of said body, and said hand grip assembly including:

a pair of bearings spaced axially of said body on opposite sides of said connector, said bearings supporting said outer portion of said hand grip assembly for movement both axially and rotatably relative to said body and rotatably relative to said nut engager section.

13. The socket wrench of claim 12 further including means for releasably retaining said nut in said channel.

14. The socket wrench of claim 13 wherein said means for releasably retaining a nut in said channel comprise a plurality of spring-biased detent members, each of said detent members comprised of a ball and a spring contained within the wall of said body wherein each of said balls movably extend into said channel for inhibiting the free passage of a nut through said channel.

15. The socket wrench of claim 12, said channel further comprising a hexagonally shaped nut chamber portion wherein in a first extended position, said nut engager is moved into said nut chamber portion and is adjacent to said open end, and in a second retracted position, said nut engager is moved out of said nut chamber portion away from said open end.

16. The socket wrench of claim 12, wherein said inner portion of said hand grip assembly of said nut ejector further comprising a tubular collar attached to said nut engager.

17. The socket wrench of claim 12 further comprising a connector at the end of said body opposite said open end, said connector arranged to engage said body with a rotary power source.

18. The socket wrench of claim 12, further comprising a cylindrical insert having a continuous open-ended wall structure defining a hexagonal interior cross-section for receiving a nut, said open end of said body having a recess for receiving said insert, said insert having an exterior area configured to matingly contact said recess of said body.

19. The socket wrench of claim 18, said insert further comprising a plurality of spring-biased detent members, each of said detent members comprised of a ball and a spring contained within the wall of said wherein each of said balls extend into said insert for inhibiting the free passage of a nut through said insert.

* * * * *